US006809706B2

(12) United States Patent
Shimoda

(10) Patent No.: US 6,809,706 B2
(45) Date of Patent: Oct. 26, 2004

(54) DRIVE CIRCUIT FOR DISPLAY DEVICE

(75) Inventor: Masamichi Shimoda, Tokyo (JP)

(73) Assignee: NEC Corporation, Tokyo (JP)

( * ) Notice: Subject to any disclaimer, the term of this patent is extended or adjusted under 35 U.S.C. 154(b) by 264 days.

(21) Appl. No.: 10/211,534

(22) Filed: Aug. 5, 2002

(65) Prior Publication Data

US 2003/0030603 A1 Feb. 13, 2003

(30) Foreign Application Priority Data

Aug. 9, 2001 (JP) ..... 2001-242103

(51) Int. Cl.[7] ..... G09G 3/10; G09G 3/30; G09G 3/36

(52) U.S. Cl. ..... 345/55; 345/78; 345/82; 345/92; 345/98; 345/100; 315/169.1; 315/169.3

(58) Field of Search ..... 345/74.1, 76, 78, 345/82, 89, 92, 98, 100, 204, 214, 211; 315/169.1, 169.3, 302

(56) References Cited

U.S. PATENT DOCUMENTS 5,008,657 A * 4/1991 Hanson et al. ..... 345/74.1
5,266,936 A * 11/1993 Saitoh ..... 345/98
5,721,563 A * 2/1998 Memida ..... 345/98
5,847,515 A * 12/1998 Lee et al. ..... 315/169.1
6,204,610 B1 * 3/2001 Komiya ..... 315/169.3
6,278,242 B1 * 8/2001 Cok et al. ..... 315/169.1
6,426,670 B1 * 7/2002 Tanaka ..... 345/211
6,433,488 B1 * 8/2002 Bu ..... 315/169.3
6,480,178 B1 * 11/2002 Itakura et al. ..... 345/89
6,525,709 B1 * 2/2003 O'Callaghan ..... 345/98
6,528,951 B2 * 3/2003 Yamazaki et al. ..... 315/169.3
6,590,570 B1 * 7/2003 Maki ..... 345/100
2002/0030647 A1 * 3/2002 Hack et al. ..... 345/82

* cited by examiner

*Primary Examiner*—Bipin Shalwala
*Assistant Examiner*—David L Lewis
(74) *Attorney, Agent, or Firm*—McGinn & Gibb, PLLC

(57) ABSTRACT

A drive circuit drives a display device including a plurality of pixels arranged as a matrix. Luminous elements are provided for the individual pixels. In this circuit, the luminous element and a drive transistor for driving the luminous element in each of the pixels are serially connected between a first power supply and a second power supply. A first switching transistor supplies the gate of the drive transistor with a control signal for controlling the drive transistor. A differential amplifier compares a voltage at a connection point between the luminous element and the drive transistor, and a control voltage which is input in the differential amplifier so as to control the luminance of the pixel, thereby generating a control signal. The control signal is supplied to the gate of the drive transistor via the first switching transistor. A hold capacitor holds a voltage between the gate and the source of the drive transistor. Thus, the drive circuit does not present a luminance unevenness, enables a high gradation display, prevents a decrease of the yield and the aperture ratio, and decreases the price and the power consumption.

12 Claims, 9 Drawing Sheets

DRIVE CIRCUIT FOR DISPLAY DEVICE

BACKGROUND OF THE INVENTION

1. Field of the Invention

The present invention relates to a drive circuit for a luminous element in a display device, and specifically relates to a drive circuit for a display device appropriate for driving a current-controlled luminous element such as organic and inorganic EL (Electro Luminescence) elements and an LED (Light Emission Diode) whose luminance is controlled by a current flowing through it.

2. Description of the Related Art

A display device where scan lines and signal lines form a matrix, and luminous elements such as organic and inorganic EL elements and LEDs are provided individual intersections of the scan lines and the signal lines to display a character as a dot matrix is widely used for a television set, a portable terminal, and an advertising board. Especially, since the elements constituting the pixels are luminous elements, this type of display devices do not require a back light for illumination while a liquid crystal display device requires it, have characteristics such as a wide view angle, and thus are attracting attention. Especially, an active drive display device, which includes switching elements integrated into the individual pixels on the matrix, and holds an image represented by the pixels for a certain period, has characteristics such as higher luminance, higher resolution, and lower power consumption compared with a passive drive display device which includes only luminous elements, and thus is especially attracting attention recently.

For this type of display device, conventionally a drive circuit shown in FIG. 1 has been used generally. In this conventional drive circuit, a scan line 201 turns on a switching transistor Tr201, a voltage on the data line 202 is written to a hold capacitor C202, and then the drive transistor Tr202 is turned on. A current corresponding to conductivity determined by the gate-source voltage of the drive transistor Tr202 flows through an EL element 200. Namely, the voltage of the data line 202 conducts analog control of gradation display. However, since the channel in a polysilicon thin film transistor used for the active drive display device is polycrystal silicon, variation of the characteristics is remarkably large compared with single crystal silicon. Thus, when the same gate voltage is written, the current varies depending on the pixels due to the variation of the characteristics of the drive transistor Tr202, a luminance becomes uneven, and consequently high gradation display becomes difficult. To overcome this defect, a drive circuit which is not affected by variation in a threshold voltage is disclosed on pages 438 to 441 by Sarnoff Corp. in "SID 99 DIGEST" in 1998 published by Society for Information Display.

The following will describe the operation thereof while referring to FIG. 2 and FIG. 3.

All of thin film transistors (Tr101 to Tr104) are constituted by P-channel transistors. In a period ①, all of the transistors Tr101 to Tr104 are turned on, and a current flows through an EL element 100. In a period ②, the transistor Tr104 turns off, a current flows on a path indicated by an arrow until the gate-source voltage Vgs of the transistor Tr102 reaches a threshold voltage Vth, and the transistor Tr102 turns off when Vgs=Vth. In a period ③, the transistor Tr103 turns off, and the voltage on a data line 102 changes VDD to Vdata. Then, the voltage generated between the both ends of the capacitor C102, namely the gate-source voltage Vgs of the transistor Tr102, becomes $-VDD+Vth+C101\cdot(VDD-Vdata)/(C101+C102)$. In a period ④, when the transistor Tr104 turns on, current I flowing through the EL element 100 is $(W\cdot u\cdot Cox/2\cdot L)\cdot((-C102\cdot VDD-C101\cdot Vdata)/(C101+C102))^2$ if the transistor Tr102 is used in the saturation region. Since this expression does not include the threshold voltage Vth, even if there is a variation in Vth, the current is not affected. Here, "L" and "W" respectively indicate channel length and channel width of the transistor Tr102, "u" is mobility, and "Cox" is gate dielectric film capacitance.

However, in this drive circuit, as the equation for calculating the current I described above clearly shows, though the variation of the threshold of the transistor can be compensated, the mobility of the transistor cannot be compensated. Thus, when there is a variation in the mobility, the luminance of the individual pixels fluctuates, and unevenness in the luminance occurs. Also, since this drive circuit requires two control liens in addition to the four transistors, the two capacitors, the scan line, and the data line, a pixel circuit becomes complicated, and the following two problems also occur.

The first problem is that probability of defects in production increases due to the complicated pixel circuit, and thus the yield decreases.

The second problem is that it is necessary to increase the current to provide intended luminance due to decrease of aperture ratio, and thus the power consumption increases.

SUMMARY OF THE INVENTION

An object of the present invention is to provide a drive circuit for a display device which does not present a luminance unevenness even when there is a variation in characteristics of a transistor, and to provide a drive circuit for a display device enabling a high gradation display.

In addition, another object of the present invention is to provide a drive circuit for a display device which prevents decrease in the yield and the aperture ratio, and decreases the price and the power consumption by simplifying the constitution of a pixel circuit.

A drive circuit for a display device according to the present invention is a drive circuit for use in a display device with a plurality of pixels arranged as a matrix and luminous elements being provided for the individual pixels. The drive circuit comprises:

drive transistors provided for the individual luminous elements and driving said luminous elements, said luminous element and said drive transistor in each of the pixels being serially provided between a first power supply and a second power supply;

a first switching transistor provided in each of the pixels for supplying a gate of said drive transistor with a control signal for controlling said drive transistor; and a differential amplifier for comparing a voltage of a connection point between said luminous element and said drive transistor in each of said pixels, and a control voltage input in said differential amplifier and indicating luminance of the pixel, and, thereby generating said control signal, wherein said control signal is supplied for the gate of said drive transistor through said first switching transistor.

In this drive circuit for a display device, as another aspect of the present invention, a second switching transistor may supplies said differential amplifier with said voltage of said connection point between said luminous element and said drive transistor in each of said pixels.

Also, both of said first switching transistor and said second switching transistor may be controlled by the same second control signal.

Said drive circuit for driving a display device may comprise a hold capacitor holding a voltage between the gate and the source of said drive transistor.

As another aspect of the present invention, a circuit for canceling an input offset may be provided for the differential amplifier.

As another aspect of the present invention, the differential amplifier may be formed on the same substrate as the pixel.

In addition to these constitutions, it is possible to further constitute such that the control voltage which is supplied for the display device, and indicates the luminance of the pixel is applied to the inverted input terminal (−) of the differential amplifier, and simultaneously, the voltage between the luminous element and the drive transistor is applied to the non-inverted input terminal (+) of the differential amplifier.

Since the present invention is constituted as described above, the first and the second switching transistors are turned on while a pixel is selected, and thus a feed back loop is formed by the differential amplifier. As a result, the gate of the drive transistor is driven such that the voltage of the image signal indicating the luminance information of the pixel and the voltage impressed on the luminous element are the same. Thus, even when there is a variation in the characteristics of the drive transistors, a variation does not present in the currents flowing through the luminous elements, and the uniformity of the display increases consequently.

BRIEF DESCRIPTION OF THE DRAWINGS

FIG. 10A is a circuit diagram showing the constitution, FIG. 10B and FIG. 10C are drawings showing equivalent circuits in individual operation modes, FIG. 10D is a drawing showing signal waveforms;

DETAILED DESCRIPTION OF THE PREFERRED EMBODIMENT

Figure 1:
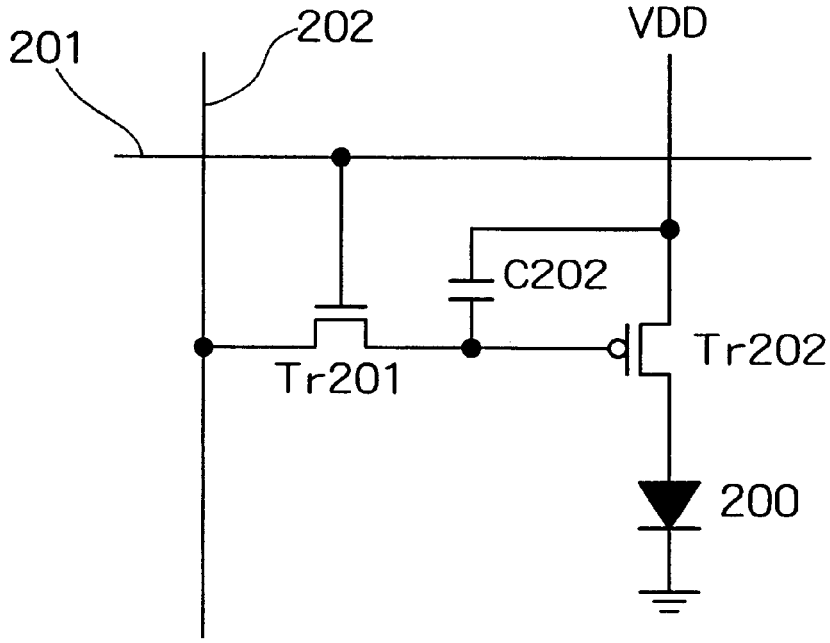
FIG. 1 (PRIOR ART)
FIG. 1 is a circuit diagram showing a constitution of a conventional drive circuit.
Figure 2:
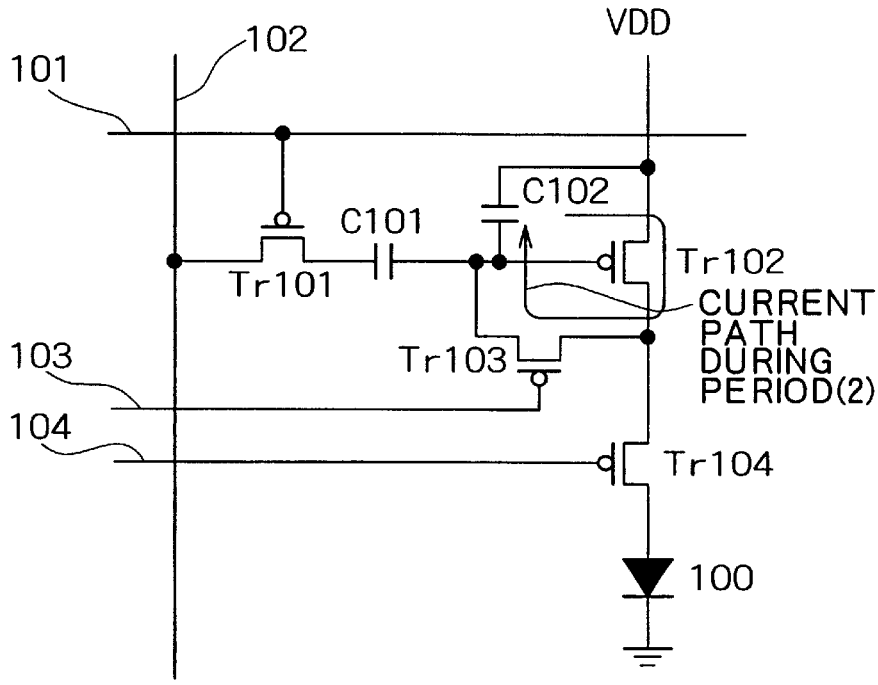
FIG. 2 (PRIOR ART)
FIG. 2 is a circuit diagram showing a constitution of a conventional drive circuit having a threshold compensation feature.
Figure 3:
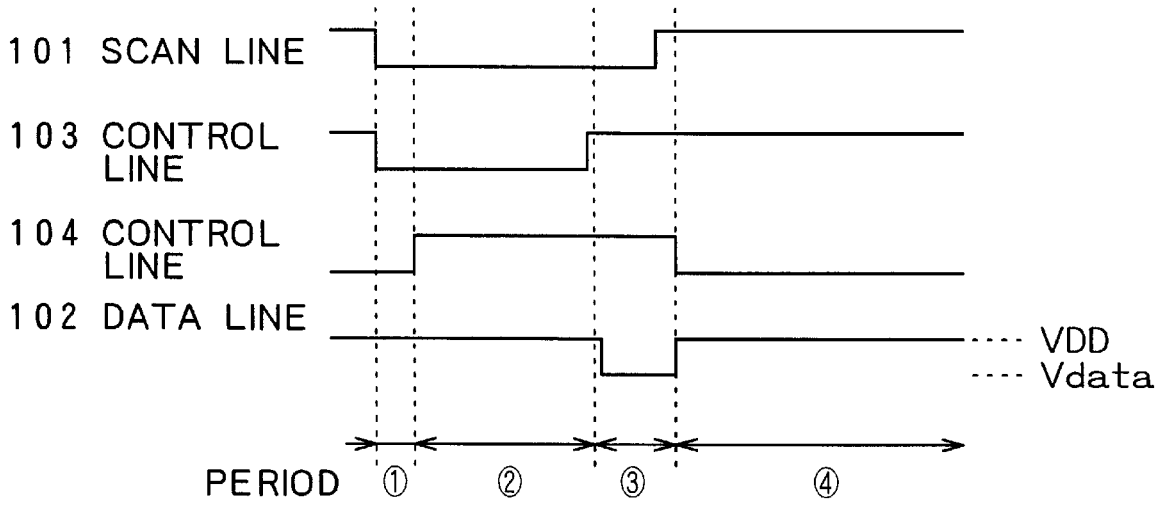
FIG. 3 (PRIOR ART)
FIG. 3 is a drawing showing signal waveforms in FIG. 2.

Preferred embodiments of the present invention will be described in detail with reference to the accompanying drawings. FIG. 4 to FIG. 11 are circuit diagrams showing drive circuits for a display device according to a first embodiment. The present invention relates to a drive circuit for a display device where a plurality of pixels are arranged as a matrix, and luminous elements are provided for the individual pixels. A luminous element 1 and a drive transistor Tr2 driving the luminous element 1 are serially provided between a first power supply VDD and a second power supply GND. A first switching transistor Tr1 supplies the gate of the drive transistor Tr2 with a control signal 13 for controlling the drive transistor Tr2. A differential amplifier 2 compares a voltage 12 at a connection point J between the luminous element 1 and the drive transistor Tr2 with a control voltage 11 which is provided for the display device and indicates the luminance of the pixel, and then the differential amplifier 2 generates the control signal 13. The control signal 13 is supplied for the gate of the drive transistor Tr2 through the first switching transistor Tr1.

A hold capacitor C1 holds a voltage between the gate and the source of the drive transistor Tr2. The first switching transistor Tr1 and a second switching transistor Tr3 are N-channel thin film transistors. The drive transistor Tr2 is a P-channel thin film transistor. As for the differential amplifier 2, a DAC output 11 indicating light emission information for the EL element 1 (a control voltage which is indicating luminance of a pixel, and is supplied for the display device) is supplied for an inverted input terminal (−), a feedback signal 12 indicating a voltage impressed on the EL element 1 (the voltage of the connection point between the luminous element and the drive transistor) is supplied for a non-inverted input terminal (+), and an output signal 13, which is a product of a difference between the input signals and an internal gain of the differential amplifier 2, is provided. As for the switching transistor Tr1, one electrode (such as the drain) thereof is connected with the output signal 13, the other electrode (such as the source) thereof is connected with the gate of the drive transistor Tr2, and the gate is connected with a scan signal 14. When the switching transistor Tr1 is turned on during a horizontal scan period by the scan signal 14, the output signal 13 is supplied for the gate of the drive transistor Tr2. As for the drive transistor Tr2, the gate thereof is connected with the source of the switching transistor Tr1, the source thereof is connected with the positive power supply VDD, and the drain is connected with the anode of the EL element 1 so as to supply the EL element 1 with a current. The hold capacitor C1 for holding the voltage for one frame period is connected between the gate and the source of the drive transistor Tr2. As for the second switching transistor Tr3, one electrode (such as the drain) thereof is connected with the anode of the EL element 1, the other electrode (such as the source) thereof is connected with the non-inverted input terminal (+) of the differential amplifier 2, and the gate is connected with the scan signal 14. When the switching transistor Tr3 is turned on during the horizontal scan period by the scan signal 14, the switching transistor Tr3 supplies the differential amplifier 2 with the voltage impressed on the EL element 1 as the feedback signal 12. The cathode of the EL element 1 is connected with the negative electrode of the power supply.

The following will specifically describe the first embodiment of the present invention.

First, a constitution of an EL display device 20 including the drive circuit of the present invention is described with reference to FIG. 8.

Figure 8:
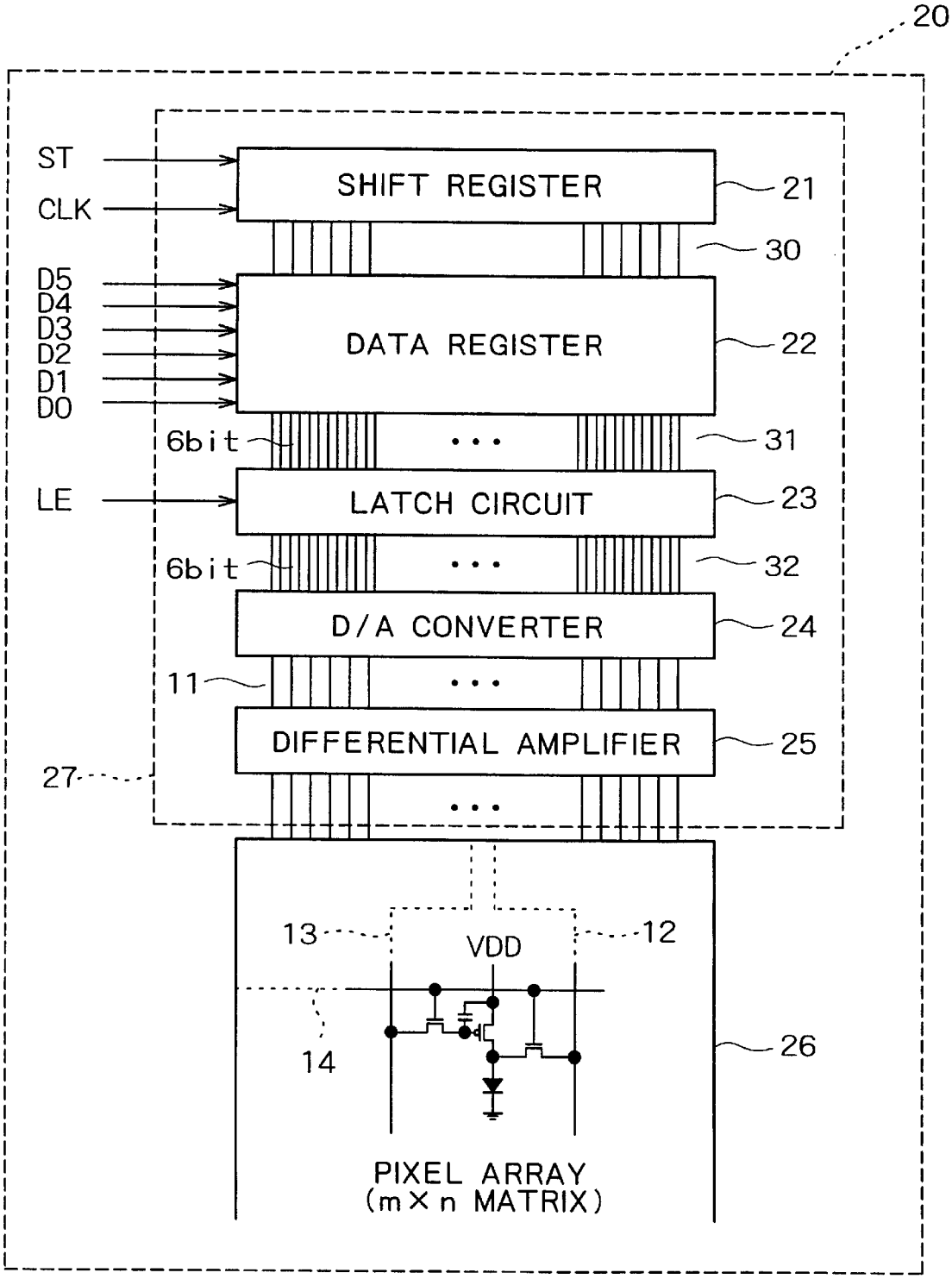
FIG. 8 is a block diagram showing a constitution of an EL display device.

FIG. 8 shows an example of the display device which includes pixels arranged as (m) lines by (n) columns, and exhibits 64 gradations and 260 thousand colors. The EL display device 20 is constituted by a shift register 21, a data register 22, a latch circuit 23, a D/A converter 24, a differential amplifier 25, and a vertical scan circuit (not shown). Circuits for the individual blocks are formed on the same glass substrate.

Based on a start signal ST and a clock signal CLK, the shift register 21 supplies the data register 22 with input signals 30 indicating timing for capturing image data signals (D0 to D5). Based on the input signals 30, the data register 22 captures the continuously supplied image data signals (D0 to D5) corresponding to one data line, and provides the latch circuit 23 with the data. The latch circuit 23 latches data based on a latch signal LE when data corresponding to (n) columns are ready in the data register 22, and provides the D/A converter 24 with the data. The D/A converter 24 conducts digital/analog conversion so as to supply the differential amplifier 2 with analog signals (the DAC outputs 11). In the present embodiment, a D/A converter is provided for the individual data line in the D/A converter 24. Namely, the DAC output 11 exists for the every data line, and the number of the data lines is (n). The differential amplifier 25 also has differential amplifiers 2 for the individual data lines. The differential amplifier 2 receives the DAC output 11, and the feedback signal 12 supplied from a pixel array 26, and supplies the output signal 13.

The following will describe the operation of the present invention.

Figure 9:
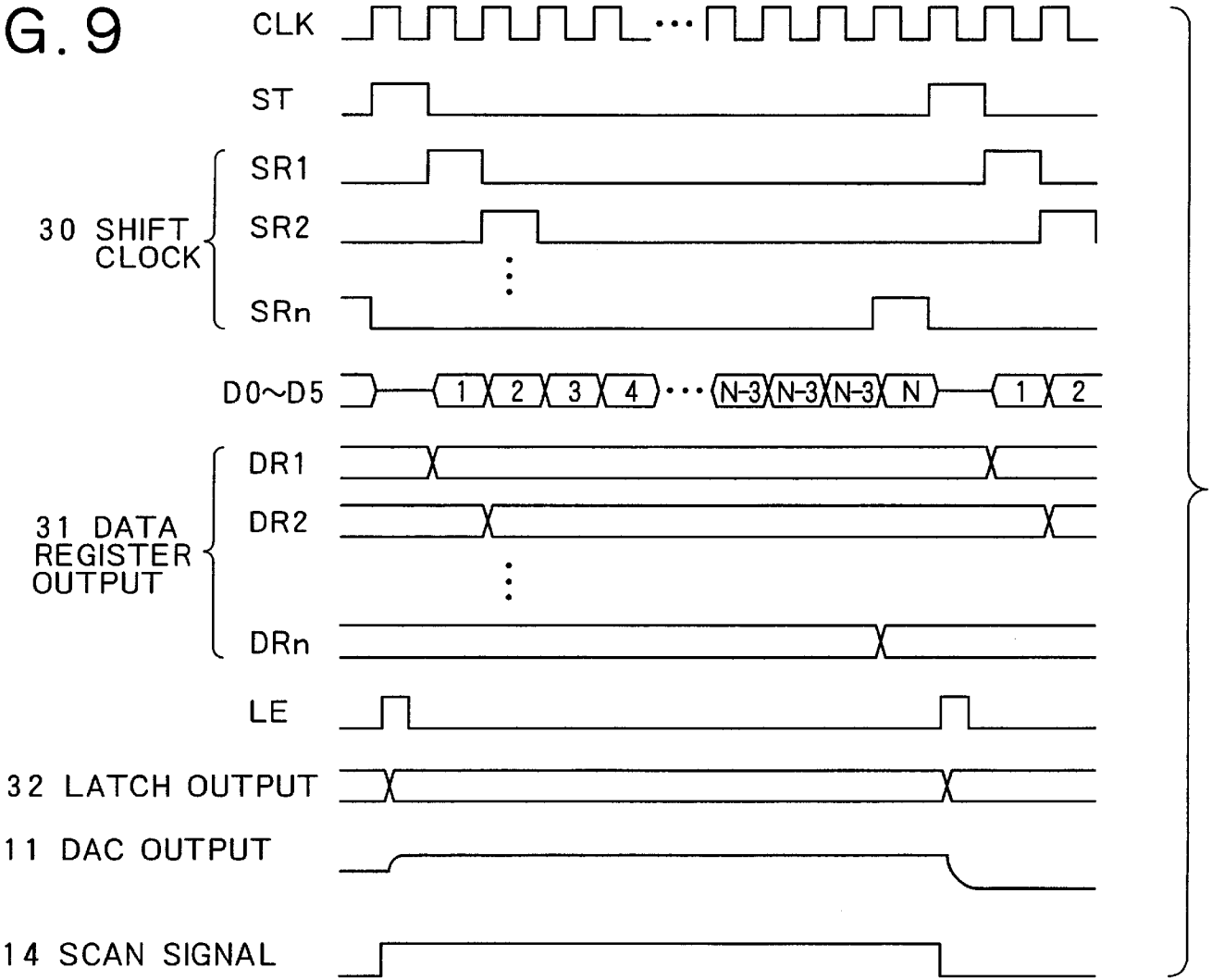
FIG. 9 is a drawing showing signal waveforms in the EL display device.

First, the operation of the EL display 20 including the drive circuit of the present invention will be described based on signal waveforms in FIG. 9.

First, when a start pulse ST rises, the shift register 21 sequentially supplies the shift clocks 30 (SR1, SR2, . . . SRn) in one horizontal period in synchronization with the reference clock CLK. The data register 22 starts sampling the digital image data (D0 to D5) on the rise of the shift clock 30, and captures the data on the fall of the shift clock 30. The digital image data (D0 to D5) for the data line for the first column is captured based on the SR1 signal, then the digital image data (D0 to D5) for the data line for the second column is captured based on the SR2 signal, and digital image data (D0 to D5) for the data line for the last nth column is captured based on the SRn signal. When the capturing the digital image data for the nth column is finished, the digital image data for the entire data lines are captured by the latch circuit 23 on the fall of the latch signal LE, and thus the latch output 32 changes. The D/A converter 24 individually supplies analog signal (DAC output 11) represented by the digital image data of six bits for the respective column. The drawing shows a waveform of the DAC output 11 for a certain data line. The output changes stepwise as the latch output 32 changes.

Figure 4:
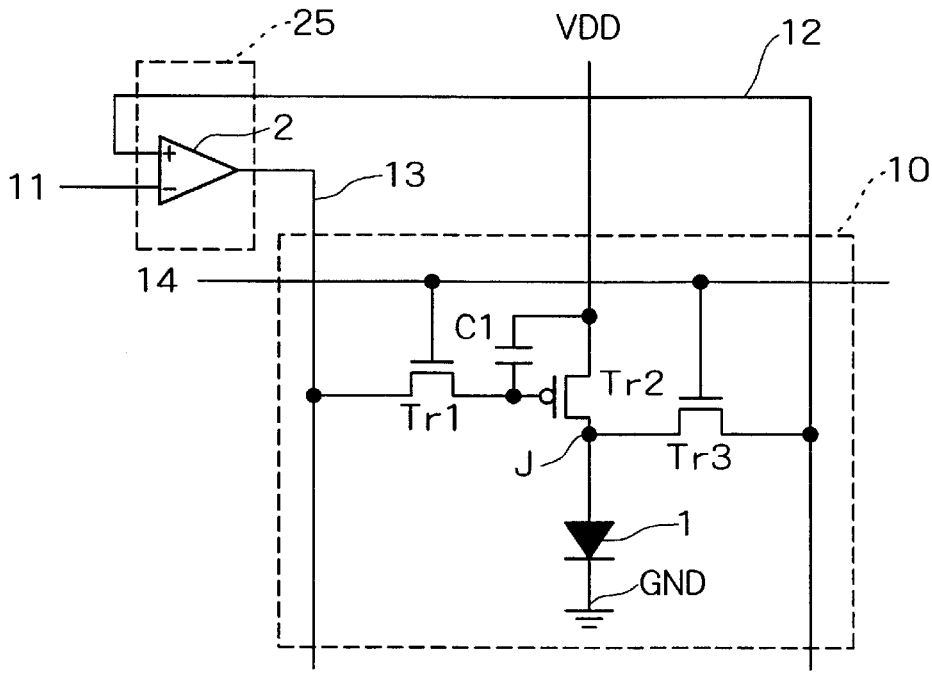
FIG. 4 is a circuit diagram showing a constitution of a first embodiment of a drive circuit of the present invention.
Figure 5:
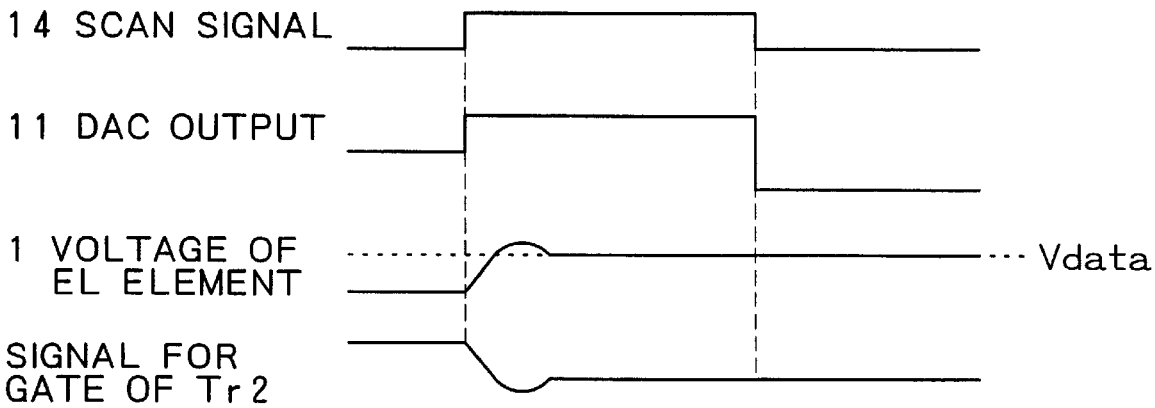
FIG. 5 is a drawing showing signal waveforms of the drive circuit of the present invention.

The following will describe the operation of the pixel for which the DAC output 11 is supplied with reference to FIG. 4 and FIG. 5.

When the scan signal 14 rises, the switching transistor Tr1 turns on, and thus the output signal 13 of the differential amplifier 2 is supplied for the gate of the drive transistor Tr2. Simultaneously, the switching transistor Tr3 turns on, and thus the voltage impressed on the EL element 1 is supplied for the differential amplifier 2 as the feedback signal 12. As a result, a feedback loop along a path comprising the output signal 13, the switching transistor Tr1, the drive transistor Tr2, the EL element 1, the switching transistor Tr3, and the feedback signal 12 is formed. Assuming that the voltage supplied from the DAC output 11 is Vdata, since the voltage of the EL element 1 is lower than Vdata when the scan starts, the output signal 13 changes toward the GND. As a result, the current supplied from the drive transistor Tr2 to the EL element 1 increases, and the voltage of the EL element 1 increases consequently. When the voltage of the EL element 1 increases, the output signal 13 changes toward the power supply VDD, the current supplied from the drive transistor Tr2 to the EL element 1 decreases, and consequently the voltage of the EL element 1 decreases. Finally, when a static state is reached, the voltage of the EL element 1 converges to a voltage the same as that of the DAC output 11.

Figure 6:
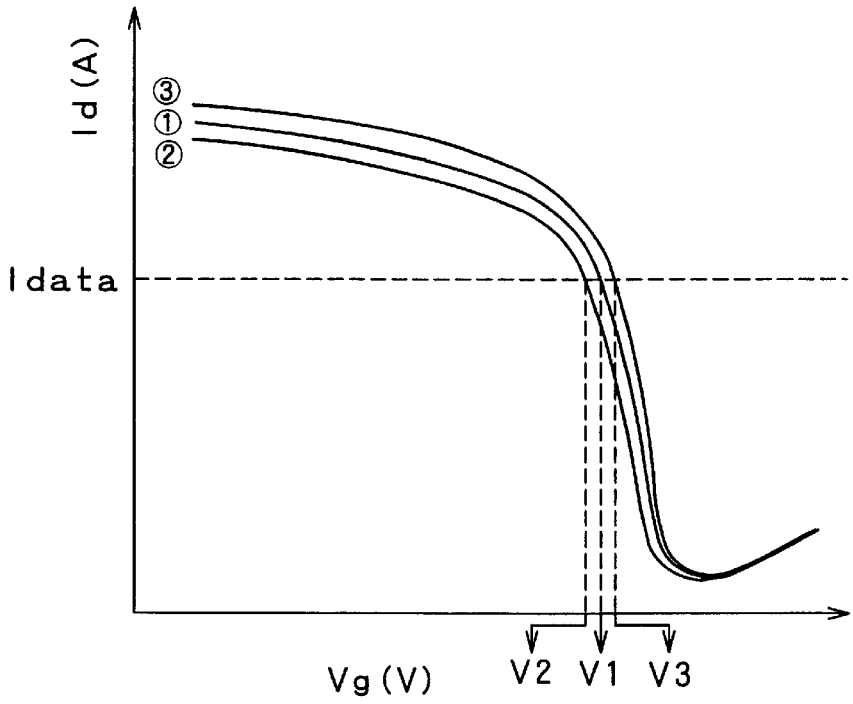
FIG. 6 is a drawing showing a gate voltage/drain current characteristic of a drive transistor Tr2.
Figure 7:
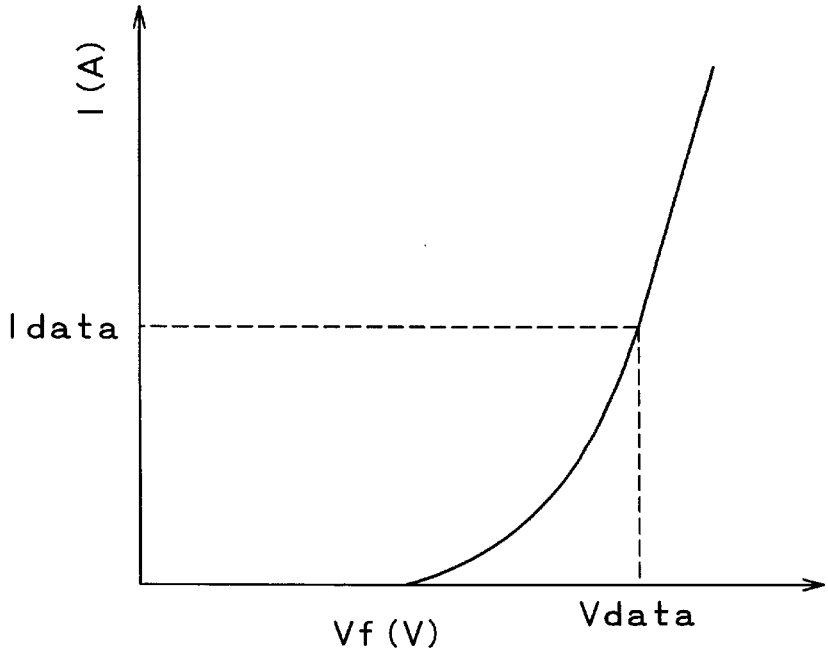
FIG. 7 is a drawing showing a voltage/current characteristic of an EL element.

The following will describe an operation when the characteristics of the drive transistor Tr2 vary with reference to FIG. 6 and FIG. 7. FIG. 6 is a drawing showing Vg-Id characteristic of the drive transistor Tr2. A curve ① shows characteristics intended during the design, and curves ② and ③ show characteristics when the variation is assumed. The characteristics shown by the curve ② have a higher threshold voltage Vt, and lower mobility than the characteristics shown by the curve ①. To the contrary, the characteristics shown by the curve ③ have a lower threshold voltage Vt, and higher mobility than the characteristics shown by the curve ①. FIG. 7 is a drawing showing a current/voltage characteristic of the EL element 1.

The voltage of the EL element 1 is the same as that of the DAC output 11, and its value is Vdata in the static state during the scan period as described above. At this moment, a current Idata flows through the EL element 1 as FIG. 7 shows. Also, at this moment, the gate voltage is lower then the power supply voltage VDD by V1 as FIG. 6 shows. The following section describes a case where the pixel includes the drive transistor Tr2 which has the characteristics indicated by the curve ②. Since the feedback loop is formed, similarly the voltage of the EL element 1 is the same as that of the DAC output 11 in the static state. At this moment, the gate voltage converges to a voltage lower than the power supply voltage VDD by V2. When the pixel includes the drive transistor Tr2 whose characteristics is shown by the curve ③, the gate voltage converges to a voltage lower then VDD by V3. Thus, even when the characteristics of the drive transistor Tr2 vary, the voltage impressed on the gate changes according to the characteristics, and thus the current flowing through the EL element 1 is always Idata. Namely, the voltage indicating the luminance (the DAC output 11) is precisely supplied for the EL element without receiving the effect of the variation of the characteristics of the drive transistor Tr2.

FIG. 10 is a circuit diagram showing an example where an offset-cancel circuit for the differential amplifier 2 is provided.

When there is a difference in the characteristics of transistors constituting the differential input in the differential amplifier 2, an offset voltage is generated between the input signals. If this voltage varies among the differential amplifiers 2 provided for the individual data lines, the variation causes an uneven display in the column direction. When a data driver including the differential amplifier 2 is constituted outside a display panel, it is possible to reduce the offset voltage by using a transistor made of single crystal silicon or the like. However, as described above, the polysilicon thin film transistor presents a large variation in the characteristics. Thus, it is preferable to arrange the two transistors constituting the differential input on regions close to each other, thereby unifying their characteristics. However, even this method may not sufficiently unify their characteristics. If this is the case, it is effective to add a circuit for canceling the input offset voltage.

Figure 10A:
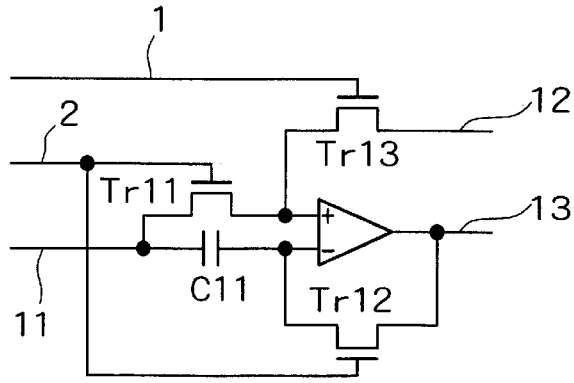
FIGS. 10A to 10D are drawings showing a differential amplifier with an offset-cancel circuit.

FIG. 10A shows a constitution of the differential amplifier 2 with the offset-cancel circuit.

The offset-cancel circuit is constituted by switching transistors Tr11, Tr12, and Tr13, and an offset compensation capacitor C11. In this circuit, all of the switching transistors are N-channel thin film transistors. The following will describe the individual connections. As for the offset compensation capacitor C11, one end thereof is connected with the DAC output 11, and the other end thereof is connected with the inverted input terminal (−) of the differential amplifier 2. One electrode (such as the drain) of the switching transistor Tr11 is connected with the DAC output 11, the other electrode (such as the source) is connected with the non-inverted input terminal (+), and the gate thereof is connected with a control line 1. As for the switching transistor Tr12, one electrode (such as the drain) thereof is connected with the output signal 13, the other electrode (such as the source) thereof is connected with the inverted input terminal (−), and the gate thereof is connected with the control line 1. As for the switching transistor Tr13, one electrode (such as the drain) thereof is connected with the feedback signal 12, the other electrode (such as source) thereof is connected with the non-inverted input terminal (+), and the gate thereof is connected with a control line 2.

Figure 10B:
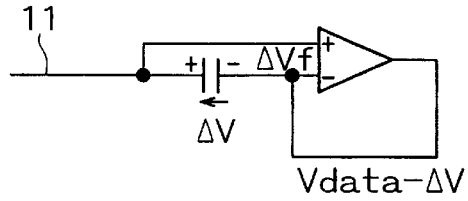
Figure 10C:
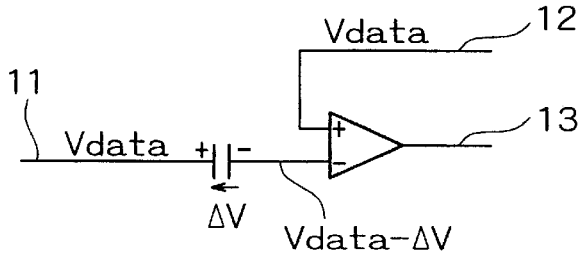
Figure 10D:
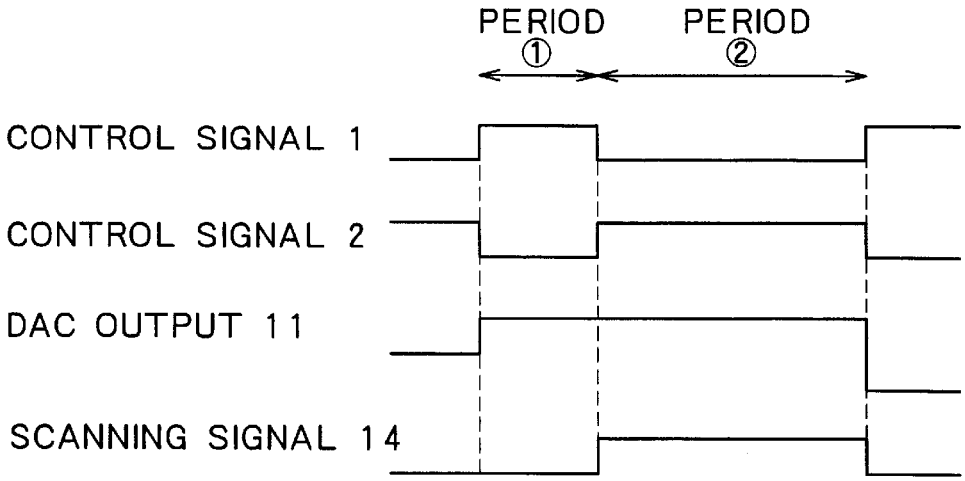

The following section describes the operation while referring to FIGS. 10B to 10D. During a period ① in FIG. 10D, the control lines 1 and 2 turn on the switching transistors Tr11 and Tr12, and turn off the switching transistor Tr13. FIG. 10B shows an equivalent circuit during the period ①. When there is an offset voltage ΔV exists between the inputs of the differential amplifier 2, since a voltage follower is formed, the offset compensation capacitor C11 is charged to ΔV. Then, the switching transistors Tr11 and Tr12 turn off, the switching transistor Tr13 turns on, and thus an equivalent circuit shown in FIG. 10C is realized in a period ②. The voltage at the inverted input terminal is (Vdata−ΔV) in the differential amplifier 2. The period ② is the period for forming the feedback loop for the pixel circuit as described above, and thus the voltage of the feedback signal 12 converges to the voltage Vdata which is higher than the voltage of the inverted input terminal by the offset voltage of ΔV in the static state. As a result, the input offset is canceled, and thus the Vdata is impressed on the EL element 1. With this constitution, as shown in FIG. 10D, it is preferable to change the rise of the scan signal 14 to the start of the period ②, thereby avoiding scanning the pixel in the period ①.

In the present embodiment, adding the circuit for canceling the input offset of the differential amplifier 2 provides the effect of preventing the variation of the luminance generated respectively on the data lines.

Figure 11:
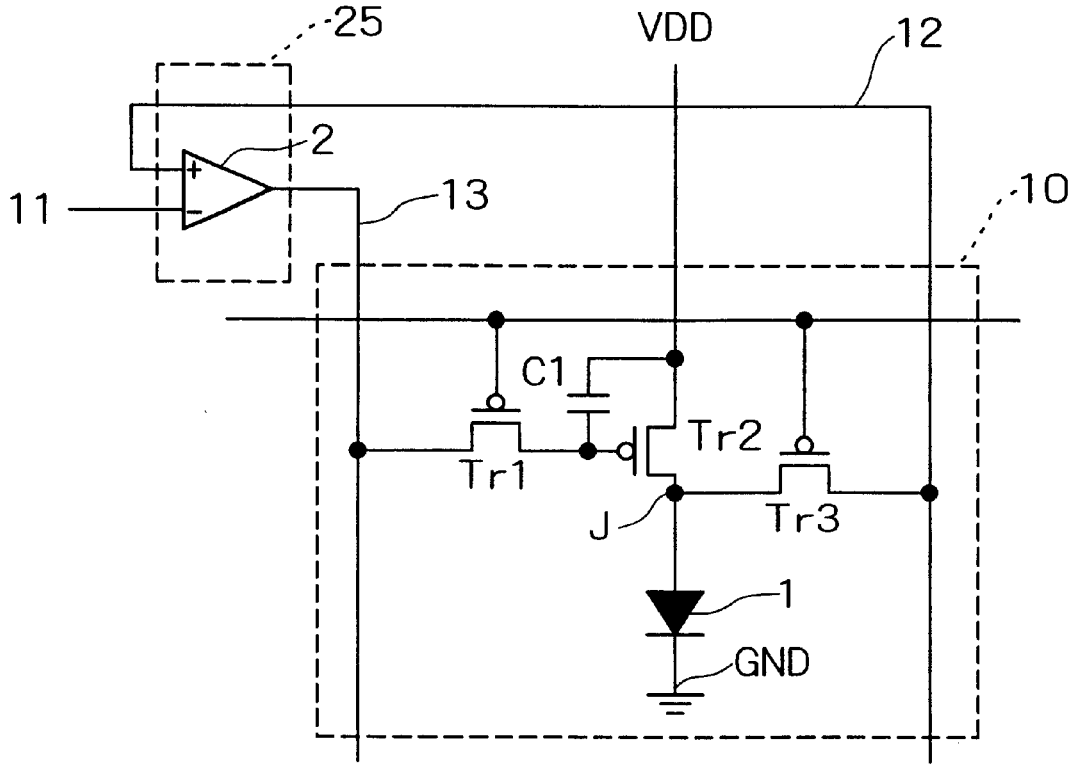
FIG. 11 is a circuit diagram showing another constitution of the first embodiment.

FIG. 11 shows a case where P-channel MOS FETs are used for the transistors Tr1 and Tr3 in FIG. 4. In this case, a signal formed by inverting the polarity of the scan signal 14 is supplied for the gate of the transistors Tr1 and Tr2.

Figure 12A:
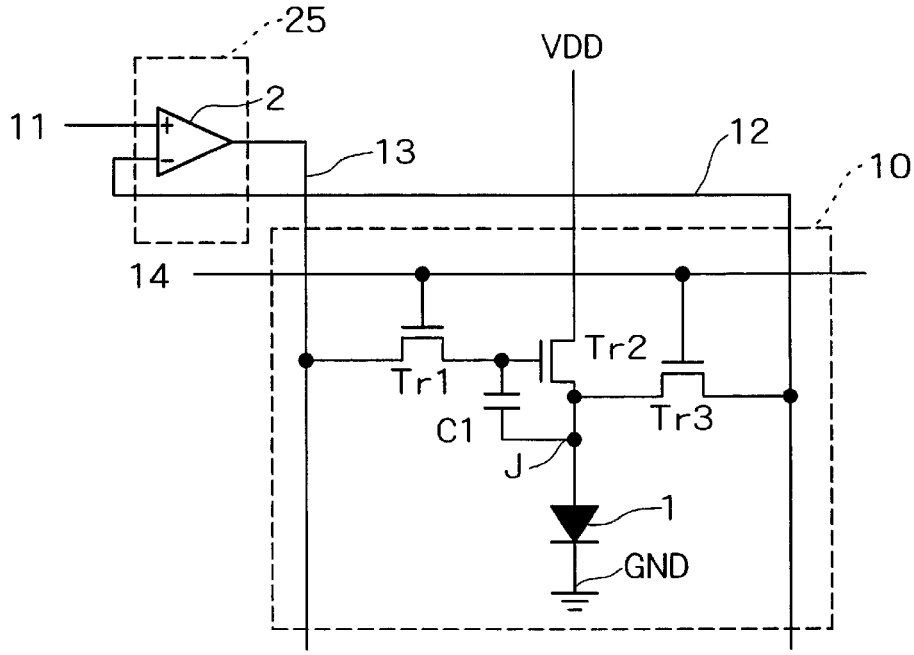
FIGS. 12A and 12B are circuit diagrams showing constitutions of a second embodiment of the present invention.
Figure 12B:
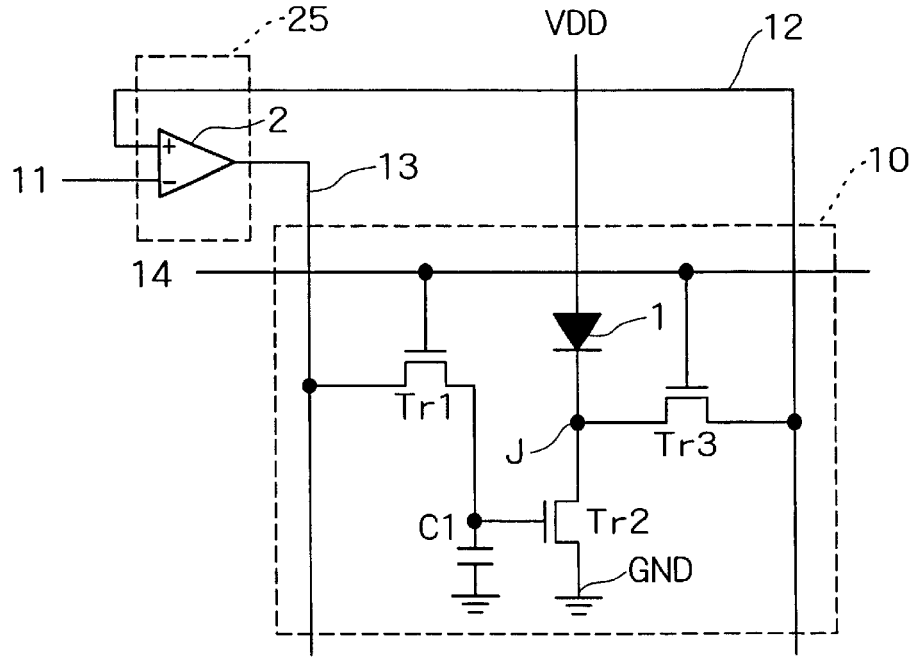

The following will describe a second embodiment of the present invention. FIG. 12A and FIG. 12B respectively show drive circuits for a display device according to the second embodiment of the present invention.

While the drive transistor Tr2 is a P-channel MOS FET in the first embodiment, the drive transistor Tr2 is an N-channel MOS FET in FIGS. 12A and 12B. In this constitution, the feedback signal 12 is supplied for the inverted input terminal (−) of the differential amplifier 2 in FIG. 12A, and the feedback signal 12 is supplied for the non-inverted input terminal (+) of the differential amplifier 2 in FIG. 12B.

In the embodiments of the present invention, although the D/A converter and the differential amplifier 2 are provided for the individual data lines, it is possible to arrange the plurality of data lines as a block, and thus to reduce the number of the D/A converters and the differential amplifiers 2. When the block includes the two data lines, the number of the circuits is reduced to ½. When the block includes the four data lines, the number of the circuits is reduced to ¼. In these cases, switching means is provided between the differential amplifier 2 and the pixel array 26, a vertical scan period is time-shared, and thus the data lines in the block are sequentially selected.

As described above, with the present invention, the switching transistors Tr1 and Tr3 turn on, and thus the negative feedback loop is formed by the differential amplifier 2 while a pixel is selected. Thus, the operation for equalizing the DAC output signal 11 indicating the luminance information of the pixel and the voltage impressed on the EL element 1 is conducted. Therefore, even if there is a variation in the characteristics of the drive transistors Tr2, the currents flowing through the luminous elements do not present a variation, and thus uneven display is prevented. In addition, adding the offset-cancel circuit for canceling the offset between the inputs of the differential amplifier 2 prevents uneven display generated respectively in the data line or the data line block. Consequently, uniformity of the display increases, and thus a display device which can present precise gradation display is provided. In addition, since the number of the transistors provided for the pixel is small (three), and simultaneously the number of the signal lines required for the pixel circuit operation (the scan line, the output signal line, and the feedback line) is small, the constitution of the pixel is simplified. As a result, an increase of the productivity is expected, and thus reducing the price of the apparatus becomes possible. Also, since the aperture ratio increase, driving the EL element 1 with a reduced current reduces the power consumption of the display device, and simultaneously increases the reliability of the display device.

What is claimed is:

1. A drive circuit which drives a display device with a plurality of pixels arranged as a matrix and luminous elements being provided for the individual pixels, the drive circuit comprising:

drive transistors provided for the individual luminous elements and driving said luminous elements, said luminous element and said drive transistor in each of the pixels being serially provided between a first power supply and a second power supply;

a first switching transistor provided in each of the pixels for supplying a gate of said drive transistor with a control signal for controlling said drive transistor; and a differential amplifier for comparing a voltage of a connection point between said luminous element and said drive transistor in each of said pixels, and a control voltage input in said differential amplifier and indicating luminance of the pixel, and, thereby generating said control signal, wherein said control signal is supplied for the gate of said drive transistor through said first switching transistor.

2. The drive circuit for driving a display device according to claim 1, further comprising a second switching transistor for supplying said differential amplifier with said voltage of said connection point between said luminous element and said drive transistor in each of said pixels.

3. The drive circuit for driving a display device according to claim 1, wherein both of said first switching transistor and said second switching transistor are controlled by the same second control signal.

4. The drive circuit for driving a display device according to claim 1, further comprising a hold capacitor holding a voltage between the gate and the source of said drive transistor.

5. The drive circuit for driving a display device according to claim 2, further comprising a hold capacitor holding a voltage between the gate and the source of said drive transistor.

6. The drive circuit for driving a display device according to claim 3, further comprising a hold capacitor holding a voltage between the gate and the source of said drive transistor.

7. The drive circuit for driving a display device according to claim 1, further comprising a circuit for canceling an input offset which is provided for said differential amplifier.

8. The drive circuit for driving a display device according to claim 2, further comprising a circuit for canceling an input offset which is provided for said differential amplifier.

9. The drive circuit for driving a display device according to claim 3, further comprising a circuit for canceling an input offset which is provided for said differential amplifier.

10. The drive circuit for driving a display device according to claim 1, wherein said differential amplifier is formed on a same substrate as the pixel.

11. The drive circuit for driving a display device according to claim 2, wherein said differential amplifier is formed on a same substrate as the pixel.

12. The drive circuit for driving a display device according to claim 3, wherein said differential amplifier is formed on a same substrate as the pixel.

* * * * *